US006867709B1

(12) United States Patent
Povey et al.

(10) Patent No.: US 6,867,709 B1
(45) Date of Patent: Mar. 15, 2005

(54) VEHICLE DETECTOR AND CLASSIFIER

(75) Inventors: Gordon Johnston Robertson Povey, Kirkcaldy (GB); Thomas Stewart McKenzie MacLean, Perth (GB)

(73) Assignee: Golden River Traffic Limited, Oxfordshire (GB)

( * ) Notice: Subject to any disclaimer, the term of this patent is extended or adjusted under 35 U.S.C. 154(b) by 0 days.

(21) Appl. No.: 09/913,565

(22) PCT Filed: Feb. 17, 2000

(86) PCT No.: PCT/GB00/00568

§ 371 (c)(1),
(2), (4) Date: Aug. 14, 2001

(87) PCT Pub. No.: WO00/49590

PCT Pub. Date: Aug. 24, 2000

(30) Foreign Application Priority Data

Feb. 18, 1999 (GB) ..... 9903783

(51) Int. Cl.[7] ..... G08G 1/01

(52) U.S. Cl. ..... 340/941; 340/933; 340/935; 324/654; 343/728; 343/748

(58) Field of Search ..... 343/728, 748, 343/776; 340/941, 936, 937, 938, 933, 935; 324/236, 239, 207.17, 654

(56) References Cited

U.S. PATENT DOCUMENTS

| | | | | | |
|---|---|---|---|---|---|
| 5,426,363 | A | * | 6/1995 | Akagi et al. | 340/941 |
| 5,614,894 | A | * | 3/1997 | Stanczyk | 340/933 |
| 5,952,981 | A | * | 9/1999 | Takeichi | 343/776 |
| 6,084,533 | A | * | 7/2000 | Morgan et al. | 340/935 |
| 6,417,784 | B1 | | 7/2002 | Hilliard et al. | 340/941 |

FOREIGN PATENT DOCUMENTS

| | | | |
|---|---|---|---|
| DE | 4234 548 C1 | 10/1992 | G08G/11/042 |
| DE | 0841647 | 10/1997 | |
| FR | 0770978 | 10/1996 | G08G/1/042 |
| GB | 0649553 | 6/1993 | G08G/0/015 |

* cited by examiner

*Primary Examiner*—Davetta W. Goins
(74) *Attorney, Agent, or Firm*—Duane Morris LLP

(57) ABSTRACT

A vehicle detector and classifier comprises a plurality of electrically conductive loops 1 arranged substantially in a plane perpendicular to a road surface, for detecting vehicle wheels. The loops can be arranged in a transverse, vertical slot 2 and housed in a flexible enclosure. An electronic circuit 3, including an oscillator, can be positioned adjacent each loop 1 in the slot 2 to energize and monitor the loop. The detector preferably also includes a conventional loop arranged substantially in the plane of the road surface, for detecting vehicle bodies, and means for superposing the results obtained from the conventional and vertical loops to aid in classifying detected vehicles.

6 Claims, 4 Drawing Sheets

VEHICLE DETECTOR AND CLASSIFIER

BACKGROUND TO THE INVENTION

The present invention relates to a vehicle detector and classifier.

There is a growing world-wide market for systems for detecting and classifying road vehicles. Road tolling, road pricing, and traffic monitoring and control are becoming increasingly important. Such systems are also likely to be of use in the automated or intelligent highways of the future. Accurate, low cost, low maintenance sensors are required which can not only detect but classify vehicles for automatic tolling and priority lane enforcement. The invention is also applicable to aircraft ground control and military vehicle classification.

One form of vehicle detector in common use comprises one or two large loops of electrically conductive material which are arranged on or in a road, substantially in the plane of the road surface. Vehicles are detected by the reduction in the inductance of the loop caused by the metallic vehicle body passing thereover.

Whilst detectors of this kind can be used to classify vehicles according to their length, they do not detect the axles or wheels of the vehicle and hence classification according to the number, type and position of axles or wheels is not possible. Such classification is, however, the accepted and sensible way to classify vehicle types.

Axle classification can be achieved by using a pneumatic tube or piezoelectric sensor in addition to the inductive loop. However, this adds to the cost, is impractical on unsurfaced roads, has a limited life span and cannot detect individual wheel configurations.

It is therefore highly desirable to provide an inductive loop vehicle detector which can detect vehicle wheels.

EP-A-0,649,553 describes a vehicle detector comprising at least one and up to eight inductive loops, having a width (extending in the direction of travel) only substantially equal to the bearing surface on the ground of the vehicle wheel (i.e. about 0.3 m for heavy goods vehicles or 0.15 m for light vehicles). The or each loop is arranged substantially in the plane of the road surface. This arrangement is able to detect vehicle wheels although the influences of the metallic masses of the body and of-the tyres of the vehicle on such,small loops are opposed.

The reason given in EP-A-0,649,553 for these opposite influences is that the loop or loops constitute a first electrical circuit, and the metallic mass of the vehicle causes a variation in the magnetic field produced by the first circuit, which in turn causes a variation in the flux linking a second circuit formed by the metallic masses in the wheel and, more particularly, by the torus formed by the wheel rim and the metallic tyre reinforcements, thus inducing a current in the second circuit.

We believe that such reasoning is erroneous since it would cause a change in the inductance of the loop opposite to the results actually described and shown in EP-A-0,649,553. In fact, whilst the large conducting area of a vehicle body causes a decrease in the loop inductance due to eddy currents, the vehicle tyre contains ferrous metal but in the form of steel bands or webbing, not in the form of a large conducting sheet. The vehicle tyre thus has a high magnetic permeability, but a relatively low electrical conductivity, and causes an increase in the loop inductance.

SUMMARY OF THE INVENTION

It is an aim of the present invention to provide a vehicle detector which is able to detect vehicle wheels, tyres and thence axles more accurately than has been possible hitherto.

Accordingly, the present invention comprises a vehicle detector and classifier comprising at least one electrically conductive loop arranged in a road surface, characterised in that the or each loop is arranged substantially in a plane perpendicular to the road surface.

Said plane may extend parallel to the axis of the road, i.e. in the direction of travel, but preferably it extends across the road. This means that a plurality of loops may be arranged in a line in a single transverse slot cut into the road surface.

The or each loop may comprise a plurality of turns. The signal processing circuitry used to sample- the inductance of the loop and operate on the samples may comprise one of a number of conventional arrangements currently used in inductive loop vehicle detectors. In this regard, some of the active electronic components, such as the oscillator, can be located in the slot adjacent to the or each loop so as to reduce interference between the loops and reduce crosstalk between the circuits. Any such components are preferably mounted on very small hybrid or thick-film circuits at regular intervals. The loop, or all of the loops, and optionally the locally mounted components, are preferably encapsulated in a semi-rigid enclosure which is strong yet flexible so as to be able to withstand the forces exerted by heavy vehicles passing thereover.

The or each loop may be of any suitable shape, for example substantially rectangular, and may, for example, have a length of between 5 and 15 cm and a width (i.e. a depth) of between 1 and 3 cm. In a particular embodiment, a plurality of loops each measure approximately 10 cm×2 cm.

In a preferred embodiment of the invention, the detector also includes an inductive loop arranged substantially in the plane of the road surface. This conventional loop is used to detect vehicle bodies whilst the or each vertically-orientated loop is used to detect wheels. Preferably, the detector includes means for superposing results obtained from the conventional and vertically-orientated loops and means for displaying the superposed results. Thus, a profile showing both the chassis and the axles or wheels of a vehicle can be viewed.

BRIEF DESCRIPTION OF THE DRAWINGS

The present invention will now be described in more detail, by way of example only, with reference to the accompanying drawings, in which.

DETAILED DESCRIPTION OF THE PREFERRED EMBODIMENTS

Figure 1:
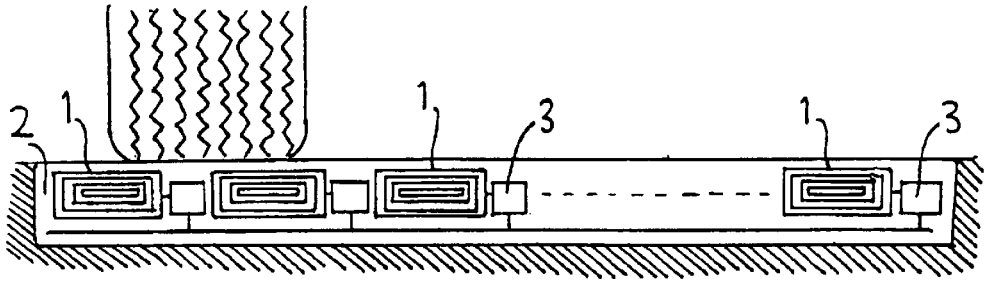
FIG. 1 is a schematic vertical elevation of a vehicle detector according to one embodiment of the invention.
Figure 2:
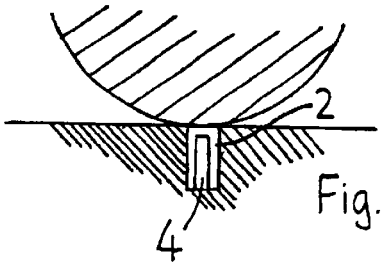
FIG. 2 is a schematic transverse section of the detector shown in FIG. 1.

FIGS. 1 and 2 show a detector comprising a linear array of inductive loops 1, the number of loops being as required to cover the width of carriageway to be monitored. For example about 20 loops can cover a width of 3 m. In this example, each loop measures 10 cm×2 cm. The array of loops is arranged in a narrow slot 2 extending transversely across a road surface. Each loop 1 comprises a plurality (e.g. 20 to 30) turns of wire. Each loop 1 is both energised and monitored by an adjacent electronic circuit 3, comprising, inter alia, an oscillator and circuitry to convert the oscillation frequency into a proportional signal voltage (not shown in detail). The circuits 3 are very small hybrid or thick-film circuits. The entire array of loops 1 and circuits 3 is housed within a semi-rigid enclosure 4 for protection against the mechanical forces exerted by vehicles passing over the detector.

The signal processing circuitry used to operate inductive loop vehicle detectors is well documented and no special adaptations are required for operating the detector of the present invention. It is not therefore necessary to set out the details of the circuitry herein. An example of such circuitry is described in EP-A-0,649,553, but other known arrangements are equally suitable for use with the present invention.

Figure 3A:
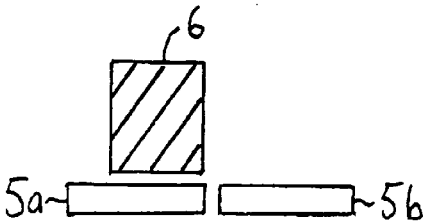
FIGS. 3*a* and 3*b* schematically show an alternative embodiment of detector at two different instants for double and single tyres respectively.
Figure 3B:
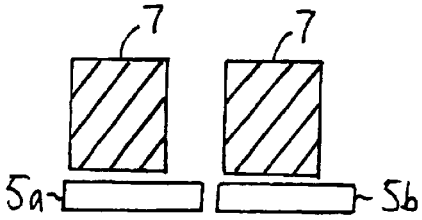
Figure 4A:
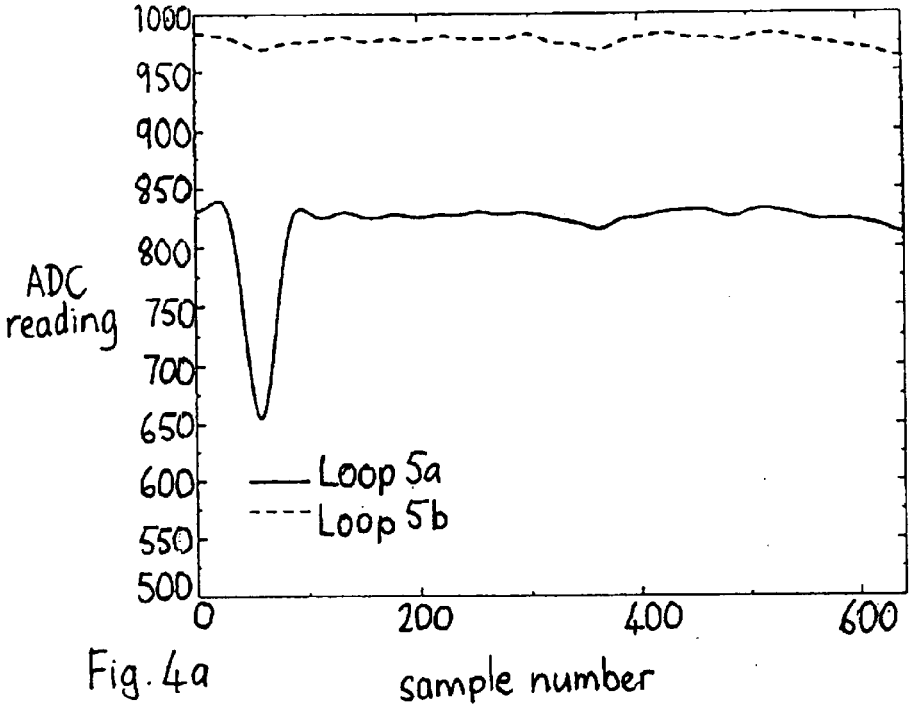
FIGS. 4*a* and 4*b* are plots of results obtained from the detector as shown in FIGS. 3*a* and 3*b* respectively.
Figure 4B:
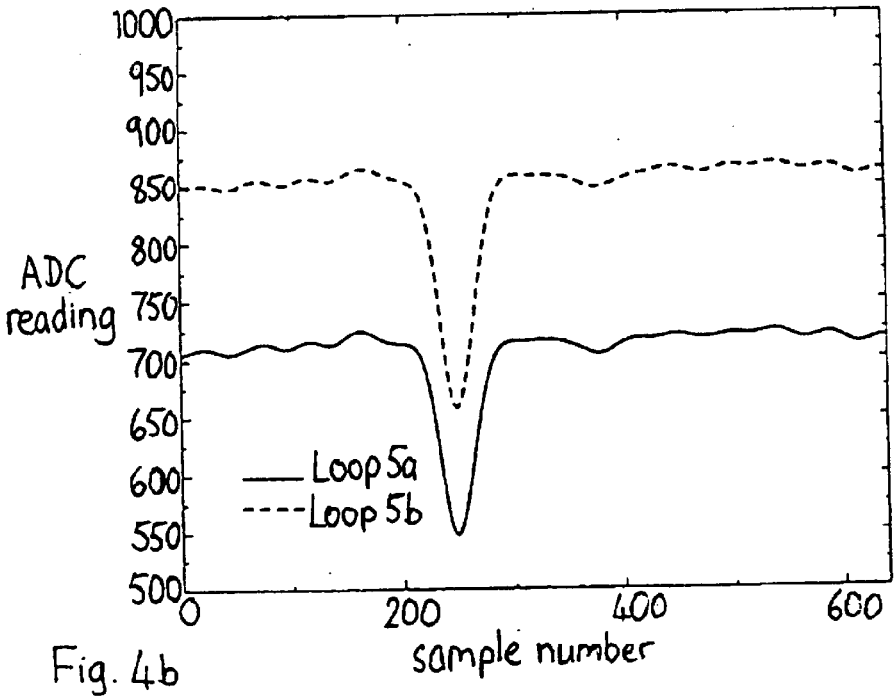

FIGS. 3*a* and 3*b* schematically show an embodiment of the invention comprising two 10 cm×2 cm loops 5*a*, 5*b* which was built and tested. The two-loop array was mounted in a narrow trench and a large van was driven thereover. FIG. 3*a* shows a front wheel 6 of the van passing over the loop 5*a* whilst FIG. 3*b* shows doubled rear wheels 7 passing over both loops 5*a*, 5*b*. The results are plotted in FIGS. 4*a* and 4*b*, with the solid line showing the ADC (analogue-to-digital converter) reading for the loop 5*a* and the broken line showing the ADC reading for the loop 5*b*. FIG. 4*a* shows the recording corresponding to FIG. 3*a* and FIG. 4*b* the recording of FIG. 3*b*. The outputs are very distinct, giving a clear indication of the presence of the wheel and it is possible to see the difference between the front and rear wheels. The presence of the large conducting area of the underside of the van has not destroyed the data relating to the wheels, as would happen with a conventional loop.

Figure 5:
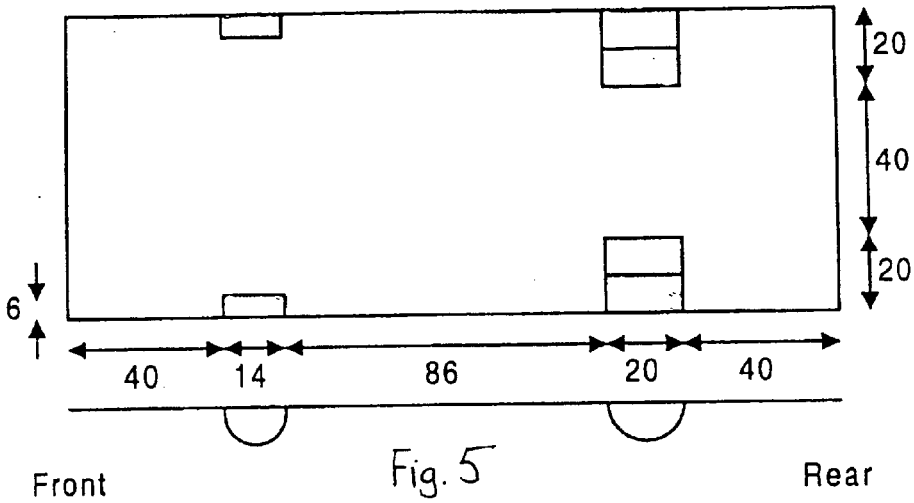
FIG. 5 is a schematic bottom view of a model vehicle.
Figure 6A:
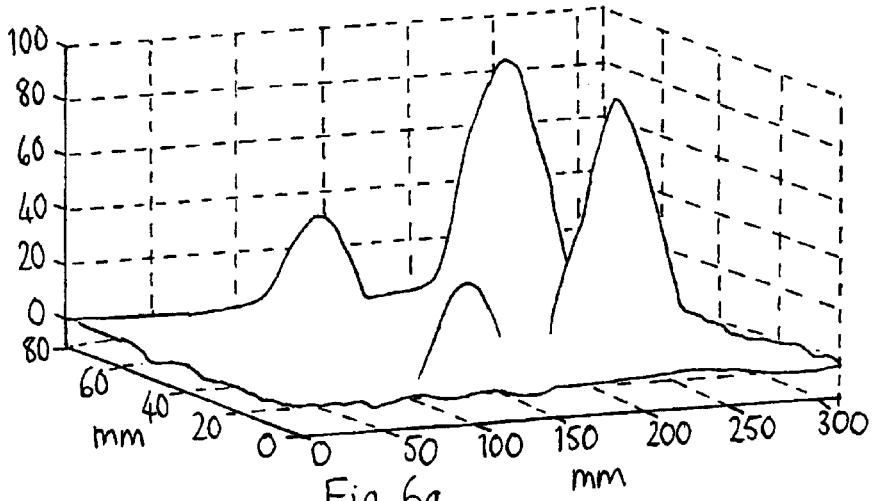
FIGS. 6*a* and 6*b* are surface and contour plots respectively obtained when the vehicle shown in FIG. 5 passes over a detector according to the invention.
Figure 6B:
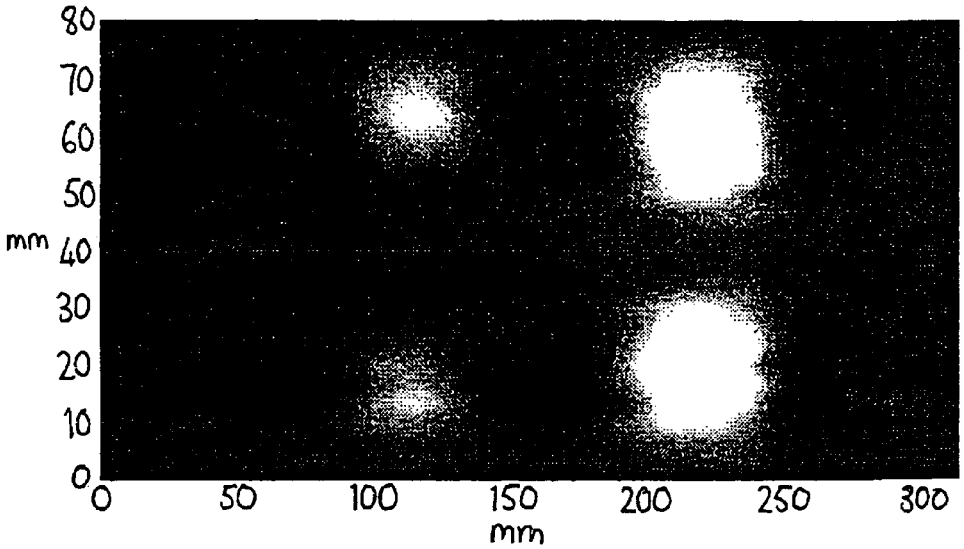

FIG. 5 shows the dimensions in mm of a scale model vehicle used to test an experimental embodiment of the invention. The model vehicle had wheels exhibiting the same properties as real vehicle wheels. FIGS. 6*a* and 6*b* show the results obtained as a 3D surface plot and a contour plot respectively.

Figure 7:
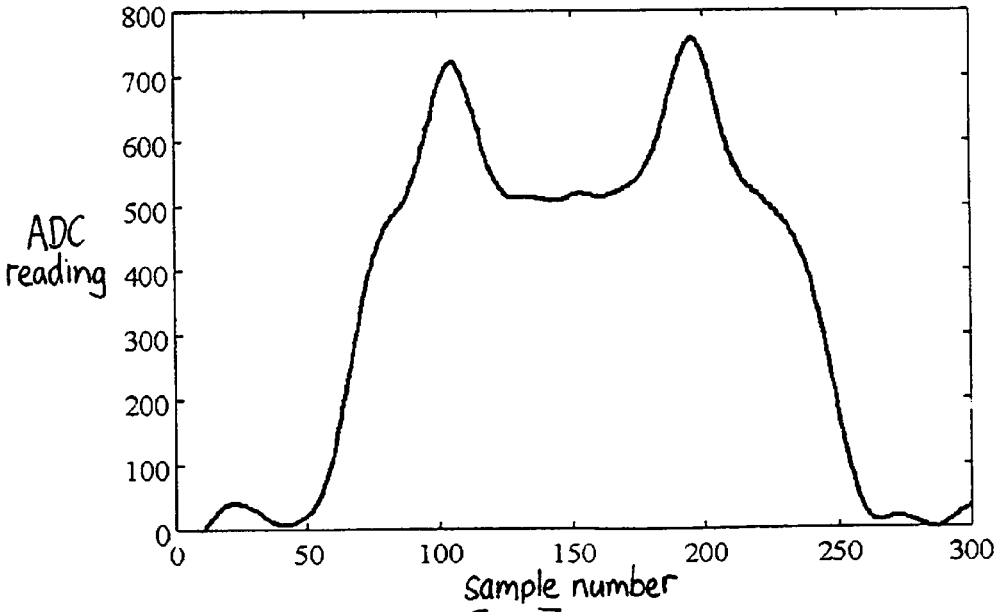
FIG. 7 is a plot of superposed results obtained from a combined detector according to another alternative embodiment.

A practical embodiment of the invention comprises at least one vertically-orientated inductive loop as described above as well as a conventional large flat loop which may be up to 1.5 to 2.5 m long in the direction of travel. Such a combined detector has been constructed. The results from the vertical and flat loops were superposed, the results from the vertical loop firstly being inverted since, as explained above, tyres cause a increase in the loop inductance whilst the vehicle body causes a decrease. The superposed results are shown in FIG. 7 as an illustration of what can be achieved. The profile indicates both the chassis and the axles of the vehicle. This could also be displayed as a 3D plot, similar to FIG. 6*a*, if an array of vertically oriented loops is used such as that shown in FIG. 1.

When the detector comprises a linear array of miniature loops it is possible to detect the track width and even the size and configuration of the vehicle wheels. The lateral position of the vehicle on the road can be detected and thus a vehicle straddling two lanes of a road is easily identified and is not mistaken for two vehicles. Metal-tracked vehicles can also be distinguished since the tracks will cause a decrease in the loop inductance, whereas tyred vehicles cause an increase in inductance.

The inductive signature of the loop(s) of the invention has a better resolution than that of conventional loops due to the size and orientation of the loop of the invention. This helps to resolve tailgating and nose-to-tail congestion problems encountered by conventional loops. This range of data is not readily available from video processing, even in good weather and lighting conditions.

What is claimed is:

1. A vehicle detector and classifier comprising:

a plurality of electrically conductive loops arranged in a line in a slot cut into a surface of a road, wherein said loops are arranged substantially in a plane perpendicular to the road surface, thereby defining an axis of each said loop extending substantially parallel to the road surface;

wherein at least one active electronic component is located in the slot and adjacent to at least one said loop;

wherein the components are mounted on circuits at regular intervals, said circuits comprising one of a small hybrid circuit and a thick film circuit.

2. A detector according to claim 1, wherein the at least one loop is encapsulated in a semirigid enclosure.

3. A detector according to claim 1, wherein said at least one loop is substantially rectangular as viewed along the axis.

4. A detector according to claim 1, wherein said at least one loop comprises a plurality of turns.

5. A detector according to claim 1, further comprising an inductive loop arranged substantially along a plane of the road surface, thereby defining an axis of the inductive loop extending substantially perpendicular to the road surface.

6. A vehicle detector and classifier comprising:

at least one electrically conductive loop arranged in a road having a road surface, wherein said at least one loop is arranged substantially in a plane perpendicular to the road surface, thereby defining an axis of the loop extending substantially parallel to the road surface;

further comprising an inductive loop arranged substantially along a plane of the road surface, thereby defining an axis of the inductive loop extending substantially perpendicular to the road surface; and, further comprising means for superposing a result obtained from the at least one loop arranged substantially along the plane of the road surface and a result obtained from the at least one loop arranged substantially in the plane perpendicular to the road surface, and means for displaying the results as thereby superposed.

* * * * *